US008119555B2

(12) United States Patent
Banerjee et al.

(10) Patent No.: US 8,119,555 B2
(45) Date of Patent: Feb. 21, 2012

(54) CARBONACEOUS MATERIAL HAVING MODIFIED PORE STRUCTURE

(75) Inventors: Chandra Kumar Banerjee, Clemmons, NC (US); Stephen Benson Sears, Siler City, NC (US); Thaddeus Jude Jackson, High Point, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 356 days.

(21) Appl. No.: 12/274,780

(22) Filed: Nov. 20, 2008

(65) Prior Publication Data

US 2010/0125039 A1 May 20, 2010

(51) Int. Cl.

| | |
|---|---|
| ***B01J 21/18*** | (2006.01) |
| ***B01J 27/20*** | (2006.01) |
| ***B01J 23/00*** | (2006.01) |
| ***B01J 23/02*** | (2006.01) |
| ***B01J 23/06*** | (2006.01) |
| ***B01J 23/40*** | (2006.01) |
| ***B01J 23/74*** | (2006.01) |
| ***C01B 31/00*** | (2006.01) |
| ***C01B 31/02*** | (2006.01) |
| ***C09C 1/56*** | (2006.01) |
| ***A24F 1/20*** | (2006.01) |
| ***A24F 13/06*** | (2006.01) |
| ***A24D 1/04*** | (2006.01) |
| ***A24D 3/00*** | (2006.01) |
| ***A24D 1/00*** | (2006.01) |
| ***A24B 15/18*** | (2006.01) |
| ***A24B 15/00*** | (2006.01) |
| ***A24B 1/00*** | (2006.01) |

(52) U.S. Cl. ..... 502/174; 502/180; 502/182; 502/183; 502/184; 502/185; 423/445 R; 423/460; 131/202; 131/207; 131/334; 131/352; 131/360; 131/364

(58) Field of Classification Search ..... 502/174, 502/180, 182–185; 423/445 R, 460; 131/334, 131/360, 364, 202, 207, 352
See application file for complete search history.

(56) References Cited

U.S. PATENT DOCUMENTS 2,881,770 A 4/1959 Touey (Continued)

FOREIGN PATENT DOCUMENTS

EP 236992 9/1987

(Continued)

OTHER PUBLICATIONS

Shen et al., Preparation of Mesoporous Caron From Commercial Activated Carbon with Steam Activation in the Presence of Cerium Oxide, "*Journal of Colloid and Interface Science*," 2003, pp. 467-473, vol. 264.

(Continued)

*Primary Examiner* — Patricia L Hailey
(74) *Attorney, Agent, or Firm* — Womble Carlyle Sandridge & Rice, LLP

(57) ABSTRACT

The invention provides a method of increasing the mesopore volume of a porous activated carbon, comprising coating a porous activated carbon with a metal oxide or metal oxide precursor to form a treated activated carbon; and calcining the treated activated carbon, in a dry atmosphere, for a time and at a temperature sufficient to increase the mesopore volume of the treated activated carbon. The invention also provides an activated carbon having a total mesopore volume of at least about 0.10 cc/g and less than about 0.25 cc/g, and a percentage of mesopore volume per total pore volume of at least about 15% and less than about 35%. Activated carbon modified according to the invention, cigarette filters incorporating such activated carbon, and smoking articles made with such filters are included in the invention.

40 Claims, 2 Drawing Sheets

U.S. PATENT DOCUMENTS 3,101,723 A 8/1963 Seligman et al.
3,217,715 A 11/1965 Berger et al.
3,236,244 A 2/1966 Irby et al.
3,311,519 A 3/1967 Touey et al.
3,313,306 A 4/1967 Berger
3,347,247 A 10/1967 Lloyd
3,349,780 A 10/1967 Sublett et al.
3,355,317 A * 11/1967 Keith, II et al. ..... 427/215
3,370,595 A 2/1968 Davis et al.
3,413,982 A 12/1968 Sublett et al.
3,551,256 A 12/1970 Watson
3,602,231 A 8/1971 Dock
3,648,711 A 3/1972 Berger et al.
3,957,563 A 5/1976 Sexstone et al.
3,972,335 A 8/1976 Tigglebeck et al.
4,174,720 A 11/1979 Hall
4,201,234 A 5/1980 Neukomm
4,223,597 A 9/1980 Lebert
4,771,795 A 9/1988 White et al.
4,970,189 A * 11/1990 Tachibana ..... 502/183
5,027,837 A 7/1991 Clearman et al.
5,076,296 A 12/1991 Nystrom et al.
5,137,034 A 8/1992 Perfetti et al.
5,188,130 A 2/1993 Hajaligol et al.
5,211,684 A 5/1993 Shannon et al.
5,246,018 A * 9/1993 Deevi et al. ..... 131/359
5,360,023 A 11/1994 Blakley et al.
5,443,560 A 8/1995 Deevi et al.
5,468,266 A 11/1995 Bensalem et al.
5,568,819 A 10/1996 Gentry et al.
5,595,577 A 1/1997 Bensalem et al.
5,622,190 A 4/1997 Arterbery et al.
5,909,736 A 6/1999 Stavridis
6,503,475 B1 1/2003 McCormick et al.
6,537,186 B1 3/2003 Veluz
6,584,979 B2 7/2003 Xue et al.
6,761,174 B2 7/2004 Jupe et al.
6,789,547 B1 * 9/2004 Paine, III ..... 131/334
6,789,548 B2 9/2004 Bereman
6,858,192 B2 * 2/2005 Graham et al. ..... 423/210
7,011,096 B2 3/2006 Li et al.
7,049,382 B2 5/2006 Haftka et al.
7,101,417 B2 * 9/2006 Graham ..... 95/136
7,237,558 B2 7/2007 Clark et al.
7,370,657 B2 5/2008 Zhuang et al.
7,569,510 B2 8/2009 Deevi et al.
2002/0002979 A1 * 1/2002 Bowen et al. ..... 131/360
2002/0014453 A1 2/2002 Lilly, Jr. et al.
2002/0020420 A1 2/2002 Xue et al.
2002/0166563 A1 11/2002 Jupe et al.
2002/0167118 A1 11/2002 Billiet et al.
2002/0172826 A1 11/2002 Yadav et al.
2002/0194958 A1 12/2002 Lee et al.
2003/0000538 A1 1/2003 Beremanet et al.
2003/0034085 A1 2/2003 Spiers et al.
2003/0106562 A1 6/2003 Chatterjee
2003/0154993 A1 8/2003 Paine et al.
2003/0168070 A1 9/2003 Xue et al.
2003/0200973 A1 10/2003 Xue et al.
2004/0194792 A1 10/2004 Zhuang et al.
2004/0226569 A1 11/2004 Yang et al.
2004/0237984 A1 12/2004 Figlar et al.
2004/0250827 A1 * 12/2004 Deevi et al. ..... 131/364
2005/0049128 A1 3/2005 Buhl et al.
2005/0066984 A1 3/2005 Crooks et al.
2005/0133051 A1 6/2005 Luan et al.
2005/0166935 A1 8/2005 Reddy et al.
2005/0274390 A1 12/2005 Banerjee et al.
2006/0025292 A1 2/2006 Hicks et al.
2006/0144410 A1 7/2006 Luan et al.
2006/0174902 A1 * 8/2006 Zhou et al. ..... 131/352
2006/0180164 A1 8/2006 Paine, III et al.
2006/0225753 A1 10/2006 Kaczmarek et al.
2007/0056600 A1 3/2007 Coleman, III et al.
2007/0204870 A1 * 9/2007 Deevi et al. ..... 131/331
2007/0215168 A1 9/2007 Banerjee et al.
2007/0251658 A1 11/2007 Gedevanishvili et al.
2008/0092912 A1 4/2008 Robinson et al.
2008/0312070 A1 * 12/2008 Talbot et al. ..... 502/80

FOREIGN PATENT DOCUMENTS

EP 419733 4/1991
EP 419981 4/1991
EP 579410 1/1994
EP 913100 10/1997
WO WO 03/059096 7/2003
WO WO 2005/023026 3/2005
WO WO 2006/051422 5/2006
WO WO 2006/064371 6/2006
WO WO 2006/103404 10/2006
WO WO 2007/096785 A2 8/2007
WO WO 2007/104908 9/2007
WO WO 2008/043982 4/2008
WO WO 2008/043983 4/2008

OTHER PUBLICATIONS

Tamai et al., "Synthesis of Extremely Large Mesoporous Activated Carbon and its Unique Adsorption for Giant Molecules," *Chem. Mater*, 1996, pp. 454-462, vol. 8.

Cazorla-Amorós, D. et al., "Selective Porosity Development by Calcium-catalyzed Carbon Gasification," *Carbon*, 1996, pp. 869-878, vol. 34, No. 7.

Dabrowski, A. et al., "Steam-carbon Gasification Catalyzed by Calcium: Assessment of the Porous Structure of Active Carbons from Plum Stones and Synthetic Active Carbons," *Adsorption*, 1997, pp. 233-242, vol. 3, No. 3.

Leboda, R. et al., "Effect of Calcium Catalyst Loading Procedure on the Porous Structure of Active Carbon from Plum Stones Modified in the Steam Gasification Process," *Carbon*, 1998, pp. 417-425, vol. 36, No. 4.

Miyamoto, J. et al., "The Addition of Mesoporosity to Activated Carbon Fibers by a Simple Reactivation Process," *Carbon*, 2005, pp. 855-857, vol. 43, No. 4.

Shen, W. et al. "Preparation of Mesoporous Carbon from Commercial Activated Carbon with Steam Activation in the Presence of Cerium Oxide", *Journal of Colloid and Interface Science*, 2003, pp. 467-473, No. 264.

Shen, W. et al., "Preparation of Mesoporous Activated Carbon Filter by Steam Activation in the Presence of Cerium Oxide and its Adsorption of Congo Red and Vitamin B12 from Solution," *Journal of Materials Science*, 2004, pp. 4693-4696, vol. 39, No. 14.

Shen, W. et al., "Development of Mesopore in Activated Carbon by Catalytic Steam Activation Over Yttrium and Cerium Oxides," *Journal of Materials Science Letters*, 2003, pp. 635-637, vol. 22, No. 8.

Tamon, H. et al., "Improvement of Mesoporosity of Activated Carbons from PET by Novel Pre-Treatment for Steam Activation," *Carbon*, 1999, pp. 1643-1645, vol. 37, No. 10.

Wang, L. et al., "Preparation of Mesoporous Carbon by Catalytic Steam Activation with Copper, Yttrium and Cerium Oxides," *Gongneng Cailiao/ Journal of Functional Materials*, 2006, pp. 607-610, 614, vol. 37.

* cited by examiner

CARBONACEOUS MATERIAL HAVING MODIFIED PORE STRUCTURE

BACKGROUND OF THE INVENTION

1. Field of the Invention

The invention relates to carbonaceous adsorbent materials useful as filtration media, as well as smoking article filters comprising carbonaceous adsorbent materials.

2. Description of Related Art

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Certain cigarettes incorporate filter elements having adsorbent materials dispersed therein, such as activated carbon or charcoal materials (collectively, carbonaceous materials) in particulate or granular form. For example, an exemplary cigarette filter can possess multiple segments, and at least one of those segments can comprise particles of high carbon-content materials. Granules of carbonaceous material can be incorporated into "dalmation" types of filter regions using the general types of techniques used for traditional dalmation filter manufacture. Techniques for production of dalmation filters are known, and representative dalmation filters have been provided commercially by Filtrona Greensboro Inc. Alternatively, granules of carbonaceous material can be incorporated into "cavity" types of filter regions using the general types of techniques used for traditional "cavity" filter manufacture. Various types of filters incorporating charcoal particles or activated carbon types of materials are set forth in U.S. Pat. No. 2,881,770 to Touey; U.S. Pat. No. 3,101,723 to Seligman et al.; U.S. Pat. No. 3,236,244 to Irby et al.; U.S. Pat. No. 3,311,519 to Touey et al.; U.S. Pat. No. 3,313,306 to Berger; U.S. Pat. No. 3,347,247 to Lloyd; U.S. Pat. No. 3,349,780 to Sublett et al.; U.S. Pat. No. 3,370,595 to Davis et al.; U.S. Pat. No. 3,413,982 to Sublett et al.; U.S. Pat. No. 3,551,256 to Watson; U.S. Pat. No. 3,602,231 to Dock; U.S. Pat. No. 3,972,335 to Tigglebeck et al.; U.S. Pat. No. 5,360,023 to Blakley et al.; U.S. Pat. No. 5,909,736 to Stavridis; and U.S. Pat. No. 6,537,186 to Veluz; U.S. Pat. Publication Nos. 2003/00340085 to Spiers et al.; 2003/0106562 to Chatterjee; 2006/0025292 to Hicks et al.; and 2007/0056600 to Coleman, III et al.; PCT WO 2006/064371 to Banerjea et al.; PCT WO 2006/051422 to Jupe et al.; and PCT WO2006/103404 to Cashmore et al., which are incorporated herein by reference.

It would be highly desirable to provide a cigarette possessing a filter element incorporating a carbonaceous material, such as particles of activated carbon, wherein the filter element possesses the ability to alter the character or nature of mainstream smoke passing through the filter element.

SUMMARY OF THE INVENTION

The invention provides a method of increasing the mesopore volume of a porous activated carbon, which results in a modified activated carbon that can alter the character or nature of mainstream smoke passing through a cigarette filter containing the modified activated carbon, such as by enhancing adsorption of certain gas phase molecules. The modified activated carbon of the invention has a unique pore volume profile with a greater percentage of mesopore volume than commonly-available activated carbons. Activated carbons of the invention can be used in a variety of filtration applications, including filtration of mainstream smoke in smoking articles such as cigarettes.

In one aspect, the invention provides a method of increasing the mesopore volume of a porous activated carbon comprising coating a porous activated carbon with a metal oxide or metal oxide precursor to form a treated activated carbon; and calcining the treated activated carbon, preferably in a dry atmosphere, for a time and at a temperature sufficient to increase the mesopore volume of the treated activated carbon. In one embodiment, the coating step comprises coating the porous activated carbon with a liquid composition comprising a liquid carrier, such as water, and a metal oxide or metal oxide precursor. The method may include an optional drying step prior to the calcining step.

The metal of the metal oxide or metal oxide precursor is typically selected from alkali metals, alkaline earth metals, transition metals in Groups IIIB, IVB, VB, VIB VIIB, VIIIB, IB, and IIB, Group IIIA elements, Group IVA elements, lanthanides, and actinides. When a metal oxide precursor is used, the precursor is typically in the form of a metal salt or an organic metal compound capable of thermal decomposition to form a metal oxide, such as metal salts selected from citrates, nitrates, ammonium nitrates, sulfates, cyanates, hydrides, amides, thiolates, carbonates, and halides. One exemplary metal oxide is cerium oxide.

The amount of metal oxide or metal oxide precursor incorporated into the activated carbon can vary, but is typically at least about 0.1 weight percent, more often at least about 1 weight percent, and most often at least about 2 weight percent.

The temperature and duration of the calcining step can vary and depends on the nature of the metal oxide and the activated carbon, as well as the desired pore structure in the final modified carbon material. When a metal oxide precursor is used for pore modification, the calcination temperature depends also on the decomposition temperature of the precursor. The temperature and duration of the calcining step can be any temperature and duration capable of providing a modified pore structure in the treated carbon material. In certain embodiments, the temperature of the calcining step is between about 250° C. and about 500° C. and the duration is between about 4 and about 24 hours. The atmosphere during calcining is preferably substantially dry, such as an atmosphere having a moisture level of no more than about 5%. Calcination may be performed in air or in an inert atmosphere such as nitrogen or helium. The time period of the calcining step is typically at least about 4 hours.

One embodiment of the method of the invention comprises coating a porous activated carbon with an aqueous composition comprising cerium oxide to form a treated activated carbon; drying the treated activated carbon; and calcining the treated activated carbon, in a dry atmosphere, for at least about 4 hours and at a temperature of at least about 250° C. in the absence of steam, such that the calcined activated carbon has a total mesopore volume of at least about 0.10 cc/g and a percentage of mesopore volume per total pore volume of at least about 15%.

In another aspect, the invention provided a modified activated carbon produced by the process of the invention, wherein the total mesopore volume is at least about 0.10 cc/g and the percentage of mesopore volume per total pore volume is at least about 15%. In one embodiment, the calcined activated carbon has a total mesopore volume of at least about 0.12 cc/g and a percentage of mesopore volume per total pore volume of at least about 20%. Still further, in certain embodiments, the calcined activated carbon has a total mesopore volume of at least about 0.10 cc/g and less than about 0.25 cc/g, and a percentage of mesopore volume per total pore volume of at least about 15% and less than about 35%.

In yet another aspect of the invention, a cigarette filter comprising the modified activated carbon of the invention is provided, such as a cigarette filter comprising a cavity positioned between two sections of fibrous filter material, the activated carbon positioned within the cavity and in granular form. Alternatively, at least one section of fibrous filter material of the cigarette filter can include the modified activated carbon, in granular form, imbedded in the fibrous filter material. Smoking articles including the filter incorporating the modified carbonaceous material are also provided.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

Figure 1:
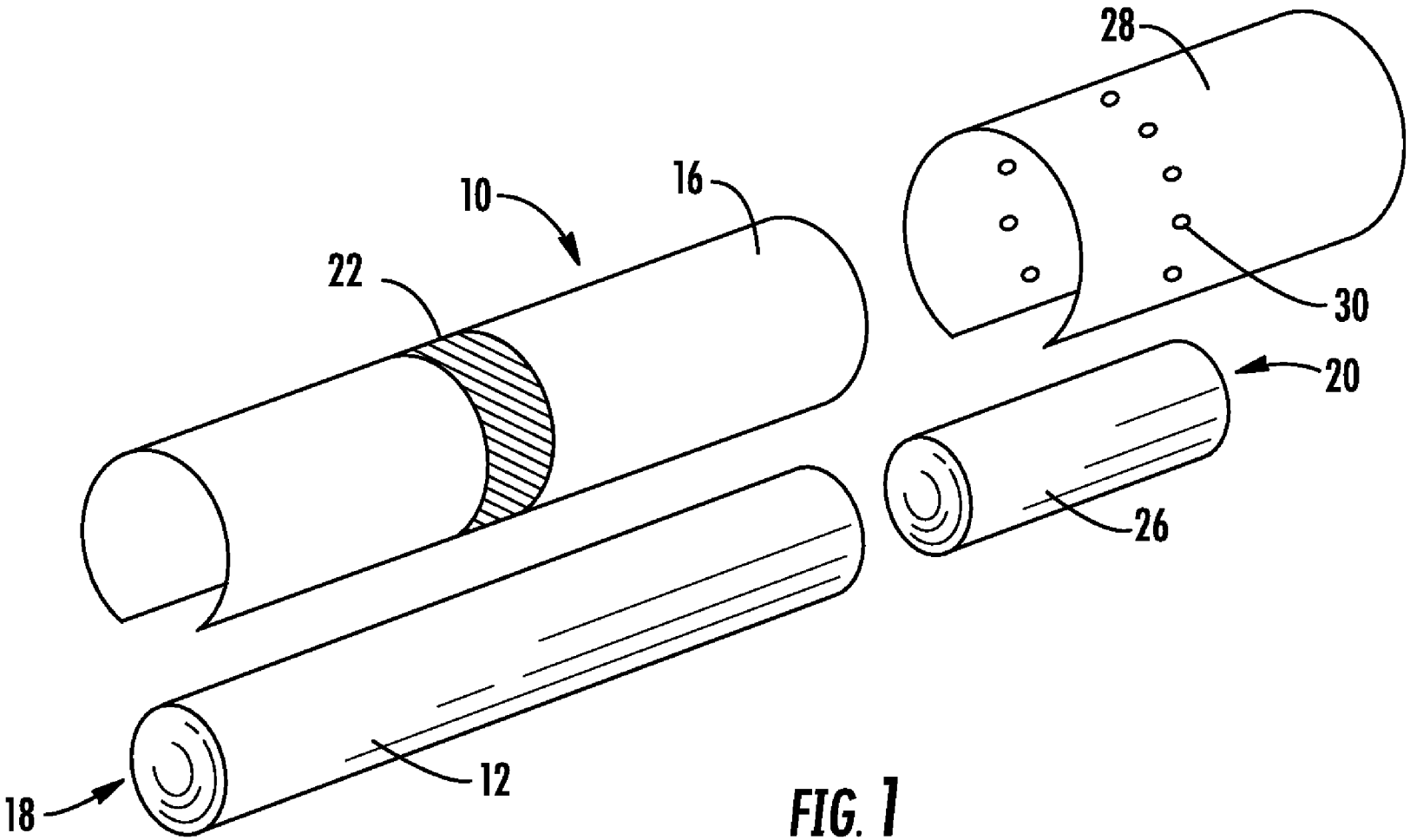
FIG. 1 is an exploded perspective view of a smoking article having the form of a cigarette, showing the smokable material, the wrapping material components, and the filter element of the cigarette.

The present inventions will now be described more fully hereinafter with reference to the accompanying drawings. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

The invention provides a method for increasing the mesopore volume within an activated carbon material. The term "mesopore" is used herein in a manner consistent with IUPAC classification, meaning pores with a width between 2 nm and 50 nm. Macropores are any pores having a width larger than 50 nm. Micropores have a pore width of less than 2 nm. See, J Rouquerol, et al. (1994) Pure Appl. Chem., 66, 1976. Surprisingly, it has been discovered that increasing mesopore volume increases the efficiency of adsorption of a wide variety of gas phase molecules, even relatively small molecules. Conventional carbonaceous adsorbents tend to have very high micropore surface areas, which are believed to enhance adsorption of smaller gas phase molecules, but relatively small mesopore volume.

Activated carbon materials modified according to the method of the invention have a total mesopore volume of at least about 0.10 cc/g, more often at least about 0.12 cc/g, and most often at least about 0.14 cc/g. Typically, the total mesopore volume is less than about 0.30 cc/g, often less than about 0.25 cc/g, and most often less than about 0.20 cc/g. The modified activated carbon materials have a volume percentage of total pores present as mesopores of at least about 15%, more often at least about 18%, and most often at least about 20%. Typically, the mesopore volume percentage is less than about 40%, often less than about 35%, and most often less than about 30%. An exemplary range of mesopore percentage is about 15% to about 30%, more often about 18% to about 25%. Pore volumes (total, macro, meso and micro) can be determined using the Brunaver, Emmet and Teller (BET) method described in *J. Amer. Chem. Soc.*, Vol. 60(2), pp. 309-319 (1938).

The method of the invention involves coating a porous activated carbon with a metal oxide or metal oxide precursor to form a treated activated carbon, and calcining the treated activated carbon, preferably in a dry atmosphere, for a time and at a temperature sufficient to increase the mesopore volume of the treated activated carbon. The metal oxide is believed to react with the carbon material, either as an oxidant or as a catalyst for the oxidation of pore walls, thereby resulting in expansion of certain pores within the carbon. Where a metal oxide precursor is used, the calcining treatment first converts the precursor to the corresponding metal oxide, which then reacts with the carbon material as described above to enhance mesopore volume. These oxidation reactions are believed to be limited to the immediate vicinity of the site of deposition of the metal oxide or metal oxide precursor particle.

The activated carbon subjected to the method of the invention can be any adsorbent material comprising a carbonaceous material. Exemplary carbonaceous materials are those composed primarily of carbon, and preferred carbonaceous materials are composed of virtually all carbon. Typically carbonaceous materials comprise carbon in amounts of more than about 85 percent, generally more than about 90 percent, often more than about 95 percent, and frequently more than about 98 percent, by weight. As used herein, activated carbon refers to any carbonaceous material, including charcoal, capable of use as an adsorbent. As understood from the use of the term "activated," the carbon material subjected to the method of the invention is preferably carbon material that has already undergone an activation process (e.g., steam activation), meaning that the present method is not intended to replace the carbon activation process.

The carbonaceous materials can be derived from synthetic or natural sources. Materials such as rayon or nylon can be carbonized, followed by treatment with oxygen to provide activated carbonaceous materials. Materials such as wood and coconut shells can be carbonized, followed by treatment with oxygen to provide activated carbonaceous materials. Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Examples of suitable carbonaceous materials are activated coconut hull based carbons available from Calgon Corp. as PCB and GRC-11 or from PICA as G277, coal-based carbons available from Calgon Corp. as S-Sorb, Sorbite, BPL, CRC-11F, FCA and SGL, wood-based carbons available from Westvaco as WV-B, SA-20 and BSA-20, carbonaceous materials available from Calgon Corp. as HMC, ASC/GR-1 and SC II, Witco Carbon No. 637, AMBERSORB 572 or AMBERSORB 563 resins available from Rohm and Haas, and various activated carbon materials available from Prominent Systems, Inc. Other carbonaceous materials are described in U.S. Pat. No. 4,771,795 to White, et al. and U.S. Pat. No. 5,027,837 to Clearman, et al.; and European Patent Application Nos. 236,922; 419,733 and 419,981.

Preferred carbonaceous materials are coconut shell types of activated carbons available from sources such as Calgon Carbon Corporation, Gowrishankar Chemicals, Carbon Activated Corp. and General Carbon Corp. See, also, for example, Activated Carbon Compendium, Marsh (Ed.) (2001), which is incorporated herein by reference.

Activated carbon materials are high surface area materials. Exemplary activated carbon materials have surface areas of more than about 200 $m^2/g$, often more than about 1000 $m^2/g$, and frequently more than about 1500 $m^2/g$, as determined using the BET method. The level of activity of the carbon may vary. Typically, the carbon has an activity of about 60 to about 150 Carbon Tetrachloride Activity (i.e., weight percent pickup of carbon tetrachloride).

Certain carbonaceous materials can be impregnated with substances, such as transition metals (e.g., silver, gold, copper, platinum, and palladium), potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the carbonaceous material as a free radical scavenger.

Various types of charcoals and activated carbon materials suitable for incorporation into cigarette filters, various other filter element component materials, various types of cigarette filter element configurations and formats, and various manners and methods for incorporating carbonaceous materials into cigarette filter elements, are set forth in U.S. Pat. No. 3,217,715 to Berger et al.; U.S. Pat. No. 3,648,711 to Berger et al.; U.S. Pat. No. 3,957,563 to Sexstone; U.S. Pat. No. 4,174,720 to Hall; U.S. Pat. No. 4,201,234 to Neukomm; U.S. Pat. No. 4,223,597 to Lebert; U.S. Pat. No. 5,137,034 to Perfetti et al.; U.S. Pat. No. 5,360,023 to Blakley et al.; U.S. Pat. No. 5,568,819 to Gentry et al.; U.S. Pat. No. 5,622,190 to Arterbery et al.; U.S. Pat. No. 6,537,186 to Veluz; U.S. Pat. No. 6,584,979 to Xue et al.; U.S. Pat. No. 6,761,174 to Jupe et al.; U.S. Pat. No. 6,789,547 to Paine III; U.S. Pat. No. 6,789,548 to Bereman; and U.S. Pat. No. 7,370,657 to Zhuang et al.; US Pat. Appl. Pub. Nos. 2002/0166563 to Jupe et al.; 2002/0020420 to Xue et al.; 2003/0200973 to Xue et al.; 2003/0154993 to Paine et al.; 2003/0168070 to Xue et al.; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2006/0144410 to Luan et al,; 2006/0180164 to Paine, III et al.; and 2007/0056600 to Coleman, III et al.; European Pat. Appl. 579410 to White; EP 913100 to Jung et al.; PCT WO2006/064371 to Banerjea et al., WO 2008/043982 to Tennison et al.; WO 2007/104908 to White et al.; WO 2006/103404 to Cashmore et al.; and WO 2005/023026 to Branton et al., which are incorporated herein by reference. Representative types of cigarettes possessing filter elements incorporating carbonaceous materials have been available as "Benson & Hedges Multifilter" by Philip Morris Inc., in the State of Florida during 2005 as a Philip Morris Inc. test market brand known as "Marlboro Ultra Smooth," and as "Mild Seven" by Japan Tobacco Inc. Sintered or foamed carbon materials (see, e.g., U.S. Pat. No. 7,049,382 to Haftka et al.) or gathered webs (see, e.g., US Pat. Appl. Pub. Nos. US 2008/0092912 to Robinson et al. and US 2007/0056600 to Coleman, III et al.) can also be used in the invention.

The carbonaceous material of the filter element is employed in a suitable form. For example, the carbonaceous material can have a form that can be characterized as powdered, granular, fibrous, particulate, monolithic, or the like. Typical particle sizes are greater than about 10 Mesh, often greater than about 20 Mesh, and frequently greater than about 30 Mesh. Typical particle sizes are less than about 400 Mesh, often less than about 300 Mesh, and frequently less than about 200 Mesh. The terms "granular" and "particulate" are intended to encompass both non-spherical shaped particles and spherical particles, such as so-called "beaded carbon" described in PCT WO03/059096 A1, which is incorporated by reference herein.

The metal oxide or metal oxide precursor coated onto the porous activated carbon may vary. Certain exemplary metal oxides are metal-containing compounds capable of catalyzing the oxidation of carbon or directly oxidizing the carbon. In US 2007/0215168 to Banerjee et al., which is incorporated by reference herein in its entirety, the use of cerium oxide is described. Additional metal-containing compounds are described in U.S. Pat. No. 6,503,475 to McCormick; U.S. Pat. No. 6,503,475 to McCormick, and U.S. Pat. No. 7,011,096 to Li et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; and 2005/0274390 to Banerjee et al., which are also incorporated by reference herein in their entirety.

The metal oxide precursor is any precursor compound that thermally decomposes to form a metal oxide. Exemplary catalyst precursors include metal salts (e.g., metal citrates, hydrides, thiolates, amides, nitrates, ammonium nitrates, carbonates, cyanates, sulfates, bromides, chlorides, as well as hydrates thereof) and metal organic compounds comprising a metal atom bonded to an organic radical (e.g., acetates, alkoxides, β-diketonates, carboxylates and oxalates). US 2007/0251658 to Gedevanishvili et al., which is incorporated by reference herein in its entirety, discloses a variety of catalyst precursors that can be used in the invention.

Examples of the metal component of the metal oxide or metal oxide precursor compound include, but are not limited to, alkali metals, alkaline earth metals, transition metals in Groups IIIB, IVB, VB, VIB VIIB, VIIIB, IB, and IIB, Group IIIA elements, Group IVA elements, lanthanides, and actinides. Specific exemplary metal elements include Ti, Zr, Hf, V, Nb, Ta, Cr, Mo, W, Mn, Re, Fe, Co, Ni, Ru, Rh, Pd, Os, Ir, Pt, Cu, Ag, Au, Zn, Y, Ce, Na, K, Cs, Mg, Ca, B, Al, Si, Ge, and Sn.

Examples of metal oxide compounds useful in the invention include iron oxides, copper oxide, zinc oxide, and cerium oxide. Exemplary metal oxide precursors include iron nitrate, copper nitrate, cerium nitrate, cerium ammonium nitrate, manganese nitrate, magnesium nitrate, zinc nitrate, and the hydrates thereof. Combinations of multiple metal oxides and/or metal oxide precursors could be used. The particle size of the metal oxide or metal oxide precursor compounds can vary, but is typically between about 1 nm to about 1 micron.

The manner in which the metal oxide or metal oxide precursor (hereinafter collectively referred to as the "metal compound") is coated onto the surface of the porous activated carbon can vary. Typically, the metal compound is dip-coated or spray-coated with a liquid composition comprising a liquid carrier and the metal compound in particulate form (i.e., a suspension or solution). Examples of solvents that may be used as the liquid carrier include water (e.g., deionized water), pentanes, hexanes, cyclohexanes, xylenes, mineral spirits, alcohols (e.g., methanol, ethanol, propanol, isopropanol and butanol), and mixtures thereof. Stabilizers, such as acetic acid, nitric acid, sodium hydroxide, ammonium hydroxide and certain other organic compounds, can be added to the suspension or solution. Alternatively, the metal compound could be applied to the surface of the porous activated carbon in dry powdered form, such as by agitation or vibration of the porous carbon material in the presence of the powdered metal compound.

In order to promote uniform impregnation, the metal compound is typically dissolved in a volume of solvent equal to the pore volume of the adsorbent. The metal compound solution is thoroughly mixed with the adsorbent and allowed to impregnate in a vacuum chamber for about two hours at room temperature.

The amount of metal oxide or metal oxide precursor that is added to the porous carbon material will vary depending on the desired final pore structure, as well as the type of metal oxide or metal oxide precursor that is utilized. Any amount that results in an enhancement of the mesopore volume of the porous carbon material can be used. Typically the amount of metal oxide is between about 0.1 weight percent and about 30 weight percent, based on the total weight of the treated carbon material, more often between about 1 weight percent and about 15 weight percent, most often between about 2 weight percent and about 7.5 weight percent. When a metal oxide precursor is used, the amount is typically between about 0.2 weight percent and about 60 weight percent, more often about 5 weight percent and about 30 weight percent, most often between about 10 weight percent and about 20 weight percent. In certain embodiments, the amount of metal oxide or metal oxide precursor material can be expressed in terms of minimal weight percentages, such as at least about 0.1 weight percent, at least about 1 weight percent, at least about 2 weight percent, at least about 5 weight percent, or at least about 10 weight percent.

Following coating of the porous activated carbon, if necessary, the coated material can be dried to remove excess solvent, such as by heating the coated material to a moderate temperature (e.g., 100-150° C.) for a time sufficient to effect the desired drying (e.g., about 1 to about 10 hours).

After the optional drying step, the coated carbon material is subjected to a calcining treatment. As used herein, calcining refers to a thermal treatment process applied to a solid material in order to bring about a thermal decomposition and/or removal of a volatile fraction from the solid material. The temperature and duration of the calcining step can vary and depends on the nature and type of metal oxide, metal oxide precursor, and activated carbon that is utilized, as well as the desired pore structure in the final modified carbon material. When a metal oxide precursor is used for pore modification, the calcination temperature depends also on the decomposition temperature of the precursor. Any temperature and duration that results in enhancement of the mesopore volume of the carbon material can be used.

The temperature of the calcining treatment can vary, but is typically within the range of about 250° C. to about 600° C. In certain embodiments, the calcining treatment temperature is at least about 250° C., more often at least about 275° C., and most often at least about 300° C. However, the desired mesopore volume modification does not require extremely high temperature treatment. Thus, the calcining temperature can be less than about 600° C., more often less than about 500° C., and most often less than about 400° C.

The length of the calcining treatment step can vary, but is typically between about 0.50 hour and about 24 hours, more often between about 2 hours and about 18 hours, and most often between about 4 hours and about 16 hours. The heat treatment step typically lasts for at least about 1 hour, more often at least about 2 hours, and most often at least about 4 hours.

The atmosphere exposed to the coated carbon material during calcination can vary, but is typically either air or an inert gas such as nitrogen, argon, and helium. Use of air or another gaseous oxygen source may serve to enhance the reaction between the metal oxide and the carbon material that produces the mesopores. The atmosphere during certain embodiments of the calcination process can be described as dry, meaning that the atmospheric moisture level during calcination is less than about 5 weight percent, based on the total weight of the headspace during calcination. Steam is not required in the method of the invention and certain embodiments of the calcining treatment can be described as conducted in the absence of steam.

Figure 2:
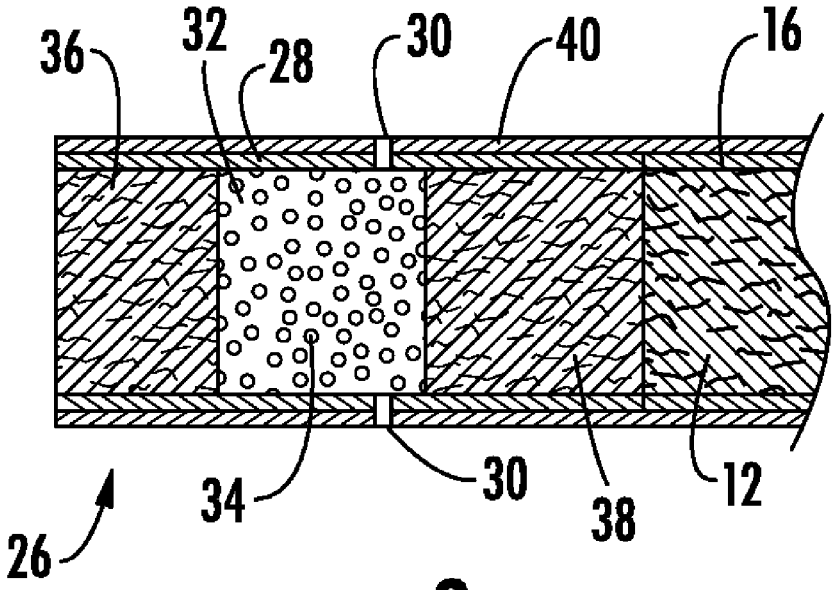
FIG. 2 is a cross-sectional view of a filter element incorporating an adsorbent material therein according to one embodiment of the present invention.
Figure 3:
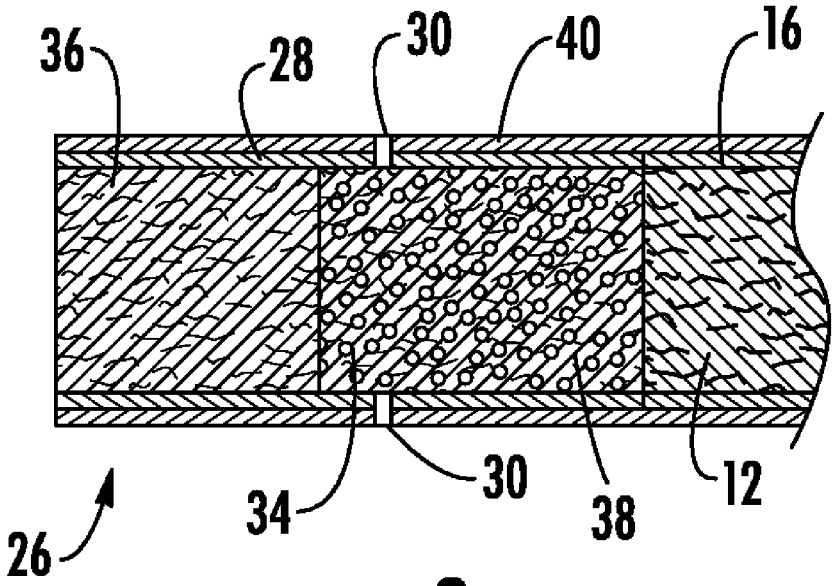
FIG. 3 is a cross-sectional view of a filter element incorporating an adsorbent material therein according to another embodiment of the present invention.

Following calcination, if desired, the treated carbon material can be washed to remove residual metal oxide/metal oxide precursor material. Thereafter, the treated activated carbon material with enhanced mesopore volume can be used as an adsorbent in a filter element of a smoking article, such as a cigarette. The treated activated carbon can be incorporated into a filter element in any manner known in the art. The carbon material can be incorporated within a filter element by incorporation within paper or other sheet-like material (e.g., as a longitudinally disposed segment of gathered, shredded, or otherwise configured paper-like material), within a segment of a cavity filter (e.g., a particles or granules within the central cavity region of a three segment or stage filter element such as shown in FIG. 2), or dispersed within a filter material (e.g., as particles or granules dispersed throughout a filter tow or gathered non-woven web material as shown in FIG. 3) as a segment of a longitudinally multi-segmented filter element. The carbonaceous material can be dispersed in the wrapping materials enwrapping the filter element or the carbonaceous material can be used in the form of carbon filaments inserted or woven into a section of filter material.

The filter element of the invention incorporates an effective amount of the modified activated carbon. The effective amount is an amount that, when incorporated into the filter element, provides some desired degree of alteration of the mainstream smoke of a cigarette incorporating that filter element. For example, a cigarette filter element incorporating activated carbon particles or granules according to the invention can act to lower the yield of certain gas phase components of the mainstream smoke passing through that filter element. Typically, the amount of carbonaceous material within the filter element is at least about 20 mg, often at least about 30 mg, and frequently at least about 40 mg, on a dry weight basis. Typically, the amount of carbonaceous material within the filter element does not exceed about 500 mg, generally does not exceed about 400 mg, often does not exceed about 300 mg, and frequently does not exceed about 200 mg, on a dry weight basis.

The moisture content of the carbonaceous material of the invention can vary. Typically, the moisture content of the carbonaceous material within the filter element, prior to use of the cigarette incorporating that filter element, is less than about 30 percent, often less than about 25 percent, and frequently less than about 20 percent, based on the combined weight of the carbonaceous material and moisture. Typically, the moisture content of the carbonaceous material within the filter element, prior to use of the cigarette incorporating that filter element, is greater than about 3 percent, often greater than about 5 percent, and frequently greater than about 8 percent, based on the combined weight of the carbonaceous material and moisture.

Filter elements incorporating the modified activated carbon of the invention can be used in a variety of smoking articles. Referring to FIG. 1, there is shown an exemplary smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 is positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. The filter element 26 is circumscribed along its outer circumference or longitudinal periphery by a layer of outer plug wrap 28.

A ventilated or air diluted smoking article can be provided with an optional air dilution means, such as a series of perforations 30, each of which extend through the tipping material 40 (as shown in FIG. 2) and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper).

As shown in FIG. 2, the filter element 26 is attached to the tobacco rod 12 using tipping material 40 (e.g., essentially air impermeable tipping paper), that circumscribes both the entire length of the filter element 26 and an adjacent region of the tobacco rod 12. The inner surface of the tipping material 40 is fixedly secured to the outer surface of the plug wrap 28 and the outer surface of the wrapping material 16 of the tobacco rod, using a suitable adhesive; and hence, the filter element and the tobacco rod are connected to one another.

The filter 26 includes a cavity 32 comprising a granular adsorbent 34. The cavity 32 is formed between two sections of filter material (e.g., two sections of plasticized cellulose acetate tow), a mouth-end segment 36 and a tobacco-end segment 38. Alternatively, instead of placement of the adsorbent in a cavity, the filter element 26 could include a tobacco-end segment of filter material 38 having the adsorbent 34 dispersed therein, as shown in FIG. 3.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the tobacco rod 12, through the filter element 26, and into the mouth of the smoker. During draw, a certain amount of certain gaseous components of mainstream smoke are removed from the mainstream smoke or neutralized by the adsorbent material 34 within the filter element 26. Filters incorporating such adsorbent material 34, such as carbonaceous adsorbent material (e.g., activated carbon particles), have the capability of capturing a wide range of mainstream tobacco smoke vapor phase components, which results in alteration of the sensory characteristics and/or chemical composition of the mainstream smoke.

The dimensions of a representative cigarette 10 can vary. Preferred cigarettes are rod shaped, and can have a diameter of about 7.5 mm (e.g., a circumference of about 20 mm to about 27 mm, often about 22.5 mm to about 25 mm); and can have a total length of about 70 mm to about 120 mm, often about 80 mm to about 100 mm. The length of the filter element 26 can vary. Typical filter elements can have lengths of about 15 mm to about 65 mm, often about 20 mm to about 40 mm.

Representative filter materials can be manufactured from tow materials (e.g., cellulose acetate or polypropylene tow) or gathered web materials (e.g., gathered webs of paper, reconstituted tobacco, cellulose acetate, polypropylene or polyester). While the filter element of the invention includes one or more sections of plasticized fibrous tow material, additional filter segments comprising other filtration materials can also be present without departing from the invention. The number of filter segments within the filter element of the invention can vary. In certain embodiments, the filter element can include 2-5 sections of plasticized filter material.

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

Multi-segment filter rods can be employed for the production of filtered cigarettes possessing multi-segment filter elements. An example of a two-segment filter element is a filter element possessing a first cylindrical segment incorporating activated charcoal particles dispersed within or throughout cellulose acetate tow (e.g., a "dalmation" type of filter segment) at one end, and a second cylindrical segment that is produced from a filter rod produced essentially of plasticized cellulose acetate tow filter material at the other end. Filter elements also can have the form of so-called "patch filters" and possess segments incorporating carbonaceous materials. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; US Pat. Appl. Pub. Nos. 2002/0166563 to Jupe et al., 2004/0261807 to Dube et al.; 2005/0066981 to Crooks et al.; 2006/0090769 to Woodson; 2006/0124142 to Zhang et al.; 2006/0144412 to Mishra et al., 2006/0157070 to Belcastro et al.; and 2007/0056600 to Coleman, III et al.; PCT WO03/009711 to Kim; and PCT WO03/047836 to Xue et al., which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and US Pat. Appl. Pub. Nos. 2005/0103355 to Holmes, 2005/1094014 to Read, Jr., and 2006/0169295 to Draghetti, each of which is incorporated herein by reference.

Filter elements of the present invention can be incorporated within the types of cigarettes set forth in U.S. Pat. No. 4,756,318 to Clearman et al.; U.S. Pat. No. 4,714,082 to Banerjea et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 Beven; and US Pat. Appl. Serial Nos. US 2007/0215167 to Crooks et al. and US 2008/00092912 to Robinson et al.; which are incorporated herein by reference. For example, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; v6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al.; U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Patent Publication Nos. 2005/0016556 to Ashcraft et al.; 2005/0066986 to Nestor et al.; 2005/0076929 to Fitzgerald et al.; and 2007/0056600 to Coleman, III et al; U.S. patent application Ser. No. 11/375,700, filed Mar. 14, 2006, to Thomas et al. and Ser. No. 11/408,625, filed Apr. 21, 2006, to Oglesby; each of which is incorporated herein by reference. See also the tipping materials and configurations set forth in U.S. Pat. Publication No. 2008/0029111 to Dube et al., which is incorporated by reference herein.

For cigarettes of the present invention that are air diluted or ventilated, the amount or degree of air dilution or ventilation can vary. Frequently, the amount of air dilution for an air diluted cigarette is greater than about 10 percent, generally greater than about 20 percent, often greater than about 30 percent, and sometimes greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and aerosol drawn through the cigarette and exiting the extreme mouth end portion of the cigarette.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available form Filtrona Instruments and Automation Ltd.

Cigarettes of the present invention, when smoked, yield an acceptable number of puffs. Such cigarettes normally provide more than about 6 puffs, and generally more than about 8 puffs, per cigarette, when machine smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder.

Cigarettes of the present invention, when smoked, yield mainstream aerosol. The amount of mainstream aerosol that is yielded per cigarette can vary. When smoked under FTC smoking conditions, an exemplary cigarette yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 20 mg, often does not exceed about 15 mg, and frequently does not exceed about 12 mg.

For the sake of brevity, carbonaceous materials are described throughout the specification as the adsorbent material of choice. However, the invention is not so limited, and the carbonaceous material could be replaced with any adsorbent material having a relatively high surface area capable of adsorbing smoke constituents without a high degree of specificity, or replaced with any adsorbent material that adsorbs certain compounds with a greater degree of specificity, such as an ion exchange resin. Exemplary alternative types of adsorbent include molecular sieves (e.g., zeolites and carbon molecular sieves), clays, ion exchange resins, activated aluminas, silica gels, meerschaum, and mixtures thereof. Any adsorbent material, or mixture of materials, that has the ability to alter the character or nature of mainstream smoke passing through the filter element could be used without departing from the invention.

In addition, while the modified carbonaceous materials of the invention are described as useful in smoking article filters, the activated carbons of the invention could be used in other gas or liquid filtration applications without departing from the invention, such as water filtration, solvent extraction, HVAC filtration, gold recovery, and the like.

EXPERIMENTAL

The present invention is more fully illustrated by the following examples, which are set forth to illustrate the present invention and are not to be construed as limiting thereof.

Example 1

About 2 g of commercially available ceria nanoparticle suspension (Alfa Aesar; 20% solids w/w) is mixed with 25 g of nanopure water. Approximately 20 g of activated carbon G277 (Pica, Columbus, Ohio) is thoroughly mixed with 27 g of the diluted ceria suspension described above. The mixture is dried at 120° C. for two hours. The resulting material is mixed with 30 ml of water, and dried overnight at 120° C. The dried carbon is calcined in air at 350° C. for 16 hours. The calcined sample is washed with 500 ml of water to remove the loosely bound ceria nanoparticles, and then dried at 120° C. overnight. A control G277 sample is treated identically but without addition of ceria nanoparticles. Pore size distribution of the samples is measured by BET analysis. Ceria treatment results in an increase in mesoporosity by 96.7% as compared to the control with the ceria-treated carbon having a mesopore volume of 0.16 cc/g (mesopore percentage of total pore volume of 25.8%) and the control having a mesopore volume of 0.07 cc/g (mesopore percentage of total pore volume of 13.1%).

Example 2

About 10 g of ceria nanoparticle suspension is mixed with 50 g of nanopure water. Approximately 40 g of activated carbon G277 is thoroughly mixed with 60 g of the diluted ceria suspension as described above. The mixture is dried at 120° C. for forty eight hours. The ceria-coated carbon is then washed with 2 liters of water to remove the loosely-bound ceria nanoparticles. The washed carbon is dried overnight at 120° C. The dried carbon is calcined in air at 350° C. for 16 hours. An untreated G277 sample served as a control. Samples were analyzed as described in Example 1. The washing step before calcination likely removed most of the ceria nanoparticle from the carbon surface. Only a 10% increase in mesoporosity is seen in the calcined sample as compared to the untreated control. The mesopore volume of the treated carbon after washing, but before calcining, dropped about 10% as compared to the control, reflecting the presence of some ceria within the pores of the carbon.

Example 3

Activated carbon samples are treated the same way as described in Example 1, except the calcination is done for 4 hours at 350° C. in a nitrogen atmosphere. A 58% increase in mesoporosity is observed in the treated sample as compared to the untreated control with the treated sample having a mesopore volume of 0.05 cc/g (mesopore percentage of total pore volume of 8.5%) and the control having a mesopore volume of 0.03 cc/g (mesopore percentage of total pore volume of 5.4%). This example suggests that mesoporosity increases as the length of the calcining treatment increases, and also suggests that a nitrogen atmosphere may limit increases in mesoporosity.

Example 4

Activated carbon samples are treated the same way as described in Example 1, except the calcination is done for 4 hours at 275° C. in air. About 144% increase in mesoporosity is observed with the treated sample having a mesopore volume of 0.14 cc/g (mesopore percentage of total pore volume of 21.3%) and the control having a mesopore volume of 0.05 cc/g (mesopore percentage of total pore volume of 8.7%).

Example 5

Activated carbon samples are treated the same way as described in Example 2, except 50 g of G277M is used instead of 40 g of G277; and the calcination was done for 10 hours at 350° C. in air. About 177% increase in mesoporosity is observed with the treated sample having a mesopore volume of 0.10 cc/g (mesopore percentage of total pore volume of 16.8%) and the control having a mesopore volume of 0.03 cc/g (mesopore percentage of total pore volume of 6.0%).

Example 6

Activated carbon samples are treated the same way as described in Example 5, except the calcination was done for 10 hours at 250° C. in air. Only 5% increase in mesoporosity is observed with the treated sample having a mesopore volume of 0.04 cc/g (mesopore percentage of total pore volume of 6.8%) and the control having a mesopore volume of 0.03 cc/g (mesopore percentage of total pore volume of 6.5%).

Example 7

The effect of ceria-treated carbon on removal efficiency of some vapor phase compounds is determined by constructing cigarettes having a cavity filled with activated carbon as described in Example 1 of U.S. Pat. No. 7,237,558 to Clark et al, which is incorporated by reference herein in its entirety. Cigarettes are fabricated with the filter cavity filled with either untreated alumina or the cerium oxide treated alumina form Example 1. The cigarettes are air diluted to about 34% and had a pressure drop of 80 mm of water and smoked under FTC conditions, as well as 60/30/2 smoking regimen (i.e., a puff volume of 60 cc; a puff interval of 30 seconds; and a puff duration of 2 seconds). The vapor phase compounds are identified and quantified by GC/MS.

Use of the ceria-treated carbon results in about 31.1% less carbonyl-containing compounds in the mainstream smoke as compared to the untreated control when smoked under FTC conditions. The ceria-treated carbon results in about 32.7% less acetaldehyde, about 35.0% less acetone, about 19.4% less acrolein, and about 3.8% less formaldehyde. When smoked under a 60/30/2 smoking regimen, the ceria-treated carbon results in about 19.1% less carbonyl-containing compounds in the mainstream smoke as compared to the untreated control. The ceria-treated carbon results in about 20.1% less acetaldehyde, about 11.8% less acetone, about 16.7% less acrolein, and about 23.8% less formaldehyde.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of increasing the mesopore volume of a porous activated carbon, comprising:

coating a porous activated carbon with a liquid composition consisting essentially of a liquid carrier and a metal oxide to form a treated activated carbon; and calcining the treated activated carbon for a time and at a temperature sufficient to increase the mesopore volume of the treated activated carbon.

2. The method of claim 1, wherein the liquid carrier is water.

3. The method of claim 1, wherein the metal is selected from the group consisting of alkali metals, alkaline earth metals, transition metals in Groups IIIB, IVB, VB, VIB VIIB, VIIIB, IB, and IIB, Group IIIA elements, Group IVA elements, lanthanides, and actinides.

4. The method of claim 1, wherein the metal oxide is cerium oxide.

5. The method of claim 1, wherein the temperature of the calcining step is between about 250° C. and about 500° C.

6. The method of claim 1, wherein said calcining occurs in a dry atmosphere.

7. The method of claim 6, wherein the dry atmosphere during the calcining step has a moisture level of no more than about 5 weight percent.

8. The method of claim 1, wherein said calcining step lasts for at least about 4 hours.

9. The method of claim 1, wherein the calcined activated carbon has a total mesopore volume of at least about 0.10 cc/g and a percentage of mesopore volume per total pore volume of at least about 15%.

10. The method of claim 1, wherein the calcined activated carbon has a total mesopore volume of at least about 0.12 cc/g and a percentage of mesopore volume per total pore volume of at least about 20%.

11. The method of claim 1, wherein the calcined activated carbon has a total mesopore volume of at least about 0.10 cc/g and less than about 0.25 cc/g, and a percentage of mesopore volume per total pore volume of at least about 15% and less than about 35%.

12. The method of claim 1, wherein the treated activated carbon comprises at least about 0.1 weight percent of the metal oxide.

13. The method of claim 1, wherein the treated activated carbon comprises at least about 1 weight percent of the metal oxide.

14. The method of claim 1, wherein the treated activated carbon comprises at least about 2 weight percent of the metal oxide.

15. An activated carbon prepared according to the method of claim 1.

16. A cigarette filter comprising the activated carbon of claim 15.

17. The method of claim 1, further comprising washing the calcined activated carbon to remove residual, metal oxide therefrom.

18. A method of increasing the mesopore volume of a porous activated carbon, comprising:

coating a porous activated carbon with a liquid composition consisting essentially of a liquid carrier and a metal oxide to form a treated activated carbon comprising at least about 0.1 weight percent of the metal oxide;

drying the treated activated carbon; and calcining the treated activated carbon for a time and at a temperature sufficient to increase the mesopore volume of the treated activated carbon, wherein the calcining temperature is less than about 600° C.

19. An activated carbon prepared according to the method of claim 18.

20. A cigarette filter comprising the activated carbon of claim 19.

21. The method of claim 18, further comprising washing the calcinated activated carbon to remove residual metal oxide therefrom.

22. A method of increasing the mesopore volume of a porous activated carbon, comprising:

coating a porous activated carbon with an aqueous composition consisting essentially of water and cerium oxide to form a treated activated carbon;

drying the treated activated carbon; and calcining the treated activated carbon, in a dry atmosphere, for at least about 4 hours and at a temperature of at least about 250° C. in the absence of steam, such that the calcined activated carbon has a total mesopore volume of at least about 0.10 cc/g and a percentage of mesopore volume per total pore volume of at least about 15%.

23. An activated carbon prepared according to the method of claim 22.

24. A cigarette filter comprising the activated carbon of claim 23.

25. The method of claim 22, further comprising washing the calcined activated carbon to remove residual cerium oxide therefrom.

26. An activated carbon having a total mesopore volume of at least about 0.10 cc/g and less than about 0.25 cc/g, and a percentage of mesopore volume per total pore volume of at least about 15% and less than about 35%.

27. A cigarette filter comprising the activated carbon of claim 26.

28. The cigarette filter of claim 27, comprising a cavity positioned between two sections of fibrous filter material, the activated carbon positioned within the cavity and in granular form.

29. The cigarette filter of claim 27, comprising at least one section of fibrous filter material, the activated carbon being in granular form and imbedded in the fibrous filter material.

30. A method of increasing the mesopore volume of a porous activated carbon, comprising:

coating a porous activated carbon with a liquid composition consisting essentially of a liquid carrier and a metal oxide precursor to form a treated activated carbon;

calcining the treated activated carbon for a time and at a temperature sufficient to thermally decompose the metal oxide precursor into a corresponding metal oxide and react the metal oxide with the activated carbon to increase the mesopore volume of the treated activated carbon.

31. The method of claim 30, wherein said calcining step lasts for at least about 4 hours.

32. The method of claim 30, wherein the calcined activated carbon has a total mesopore volume of at least about 0.10 cc/g and a percentage of mesopore volume per total pore volume of at least about 15%.

33. The method of claim 30, wherein the calcined activated carbon has a total mesopore volume of at least about 0.12 cc/g and a percentage of mesopore volume per total pore volume of at least about 20%.

34. The method of claim 30, wherein the calcined activated carbon has a total mesopore volume of at least about 0.10 cc/g and less than about 0.25 cc/g, and a percentage of mesopore volume per total pore volume of at least about 15% and less than about 35%.

35. The method of claim 30, wherein the treated activated carbon comprises at least about 0.1 weight percent of the metal oxide precursor.

36. The method of claim 30, wherein the treated activated carbon comprises at least about 1 weight percent of the metal oxide precursor.

37. The method of claim 30, wherein the treated activated carbon comprises at least about 2 weight percent of the metal oxide precursor.

38. The method of claim 30, wherein the metal oxide precursor is in the form of a metal salt selected from the group consisting of citrates, nitrates, ammonium nitrates, sulfates, cyanates, hydrides, amides, thiolates, carbonates, halides, and hydrates thereof.

39. The method of claim 30, wherein the metal oxide precursor comprises cerium.

40. The method of claim 30, further comprising washing the calcined activated carbon to remove residual metal oxide therefrom.

* * * * *